United States Patent [19]

Otomura et al.

[11] Patent Number: 4,702,979

[45] Date of Patent: Oct. 27, 1987

[54] METHOD OF FORMING IMAGE

[75] Inventors: Satoshi Otomura, Chiba; Narihito Kojima, Numazu, both of Japan

[73] Assignee: Ricoh Co., Ltd., Tokyo, Japan

[21] Appl. No.: 889,648

[22] Filed: Jul. 24, 1986

Related U.S. Application Data

[63] Continuation-in-part of Ser. No. 765,904, Aug. 14, 1985, abandoned.

[30] Foreign Application Priority Data

Aug. 22, 1984 [JP] Japan ..... 59-173388

[51] Int. Cl.[4] ..... G03G 13/24; G03G 17/02

[52] U.S. Cl. ..... 430/52; 430/55

[58] Field of Search ..... 430/52, 55, 58

[56] References Cited

U.S. PATENT DOCUMENTS

| | | | |
|---|---|---|---|
| 3,082,085 | 3/1963 | Miller et al. | 430/52 |
| 3,953,207 | 4/1976 | Horgan | 430/58 |
| 3,977,870 | 8/1976 | Rochlitz | 430/58 X |

FOREIGN PATENT DOCUMENTS

| | | | |
|---|---|---|---|
| 43-24747 | 10/1968 | Japan | 430/52 |

*Primary Examiner*—Roland E. Martin

*Attorney, Agent, or Firm*—Flynn, Thiel, Boutell & Tanis

[57] ABSTRACT

This invention relates to a method of forming an image, characterized by applying voltage on a photosensitive material having a photoconductive layer and an electroconductive layer on a substrate in such a manner as to make said electroconductive layer positive and said photoconductive layer negative while irradiating optical information on said positive electroconductive layer or said negative photoconductive layer, thereby causing an anodic ion reaction on the interface between said electroconductive layer and said photoconductive layer to selectively change the spectral absorption properties of at least one of said electroconductive layer and said photoconductive layer depending on the irradiated optical information; said photosensitive material comprising an electroconductive layer of metal as a simple substance, its alloy or its metal compound applied on a substrate and a photoconductive layer overlaid on said electroconductive layer.

14 Claims, 3 Drawing Figures

METHOD OF FORMING IMAGE

This is a continuation-in-part of application Ser. No. 765,904 filed Aug. 14, 1985, now abandoned.

BACKGROUND OF THE INVENTION

The present invention relates to a novel method of forming an image using a photoconductive material. Particularly, the present invention relates to a method for recording an optical information pattern by selectively causing an ionic reaction in a recording medium by transferring constant charge formed on a part irradiated with light under an electric field.

Heretofore, many methods have been proposed for providing photographs, in a broad sense, for recording optical information, and many of them have been put to practical use in various forms.

Examples of photographic methods widely used at present include silver halide photography, diazo the like. Various modified styles of these methods such as silver halide diffusion-transferring method, diazo type bubble system, electrostatically transferring electrophotography and the like have also been put to practical use. Developments of materials for photochromic photography, thermal photography and the like have also proceeded.

Performances of photographs are generally evaluated in view of the properties of sensitivity, spectral sensitivity (color sensitivity), gradation, resolving power (information density), granularity (S/N ratio), ease of handling, possibility of coloring, and the like. In addition to these properties, other properties such as non-toxicity (non-pollution), the saving of resources, mass productivity, processability, durability, cost and the like should be taken into consideration.

Under these circumstances, there have not been developed materials and systems which satisfy many of the above mentioned performances and properties at the same time.

For example, silver halide photography is notably excellent in sensitivity, and provides satisfactory resolving power and gradation. However, it has the disadvantages that development treatment is complicated and hard to control, and that expensive silver must be used.

Diazo photography is cheap, but the sensitivity to visible light is remarkably low. Therefore, a special light source generating ultraviolet ray is required, and ammonia gas, alkaline solution and the like must be used for development, thus causing handling to be difficult.

In the case of the transfer method of electrophotography, a photosensitive material is repeatedly usable and therefore the running cost is low and its sensitivity is satisfactorily high for practical use. However, since a series of processes such as charging with electricity, exposure, development, transfer, cleaning and the like must be conducted under predetermined conditions, its apparatus is most complicated, and thus the apparatus cost is the highest among the conventional methods. In addition to these disadvantages, the subject to be electrophotographed is limited to a plane copy.

Taking the above mentioned circumstances into consideration, we have found in the process of developing a new electrophotographic material, a method of forming an image using a photosensitizer of basically the same type as the conventional electrophotographic material, but using a novel system fundamentally different from the conventional electrophotographic system.

We believe the novel system of this invention is ideal in view of the above mentioned properties and performances.

SUMMARY OF THE INVENTION

An object of the present invention is to provide a novel method of forming an image, which has various satisfactory performances such as a sensitivity sufficient for practical use, capability of controlling spectral sensitivity, and resolving power, gradation, and particle properties substantially the same or higher in comparison with conventional silver salt photography; the method of the present invention does not require a developing treatment and it has excellent properties in view of environmental pollution, saving of resouces, material cost and apparatus cost as compared with conventional methods.

That is, an object of the present invention is to provide a method of forming an image, characterized by applying voltage on a photosensitive material having a photoconductive layer and a metallic electroconductive layer on a substrate in such a manner as to make said electroconductive layer positive and said photoconductive layer negative while irradiating optical information on said positive electroconductive layer or said negative photoconductive layer, thereby causing an anodic ion reaction on the interface between said electroconductive layer and said photoconductive layer to selectively change the spectral absorption properties of at least one of said electroconductive layer and said photoconductive layer depending on the irradiated optical information; said photosensitive material comprising a metallic electroconductive layer applied on a support and a photoconductive layer overlaid on said electroconductive layer.

DETAILED DESCRIPTION OF THE INVENTION

A method of forming an image in accordance with the present invention is characterized by applying voltage on a photosensitive material having a photoconductive layer and an electroconductive layer on a substrate in such a manner as to make said electroconductive layer positive and said photoconductive layer negative while irradiating optical information on said positive electroconductive layer or said negative photoconductive layer, thereby causing an anodic ion reaction on the interface between said electroconductive layer and said photoconductive layer to selectively change the spectral absorption properties of at least one of said electroconductive layer and said photoconductive layer depending on the irradiated optical information; said photosensitive material comprising an electroconductive layer of metal, its alloy or its metal compound applied on a substrate and a photoconductive layer overlaid on said electroconductive layer.

The present invention is further illustrated in accordance with the drawings.

Figure 1:
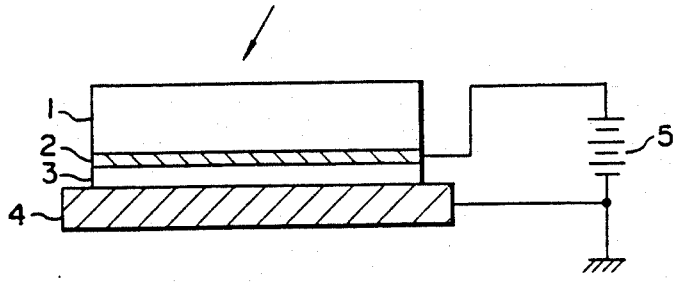
FIGS. 1 to 3 illustrates photosensitive materials used for practicing the method of the present invention.
Figure 2:
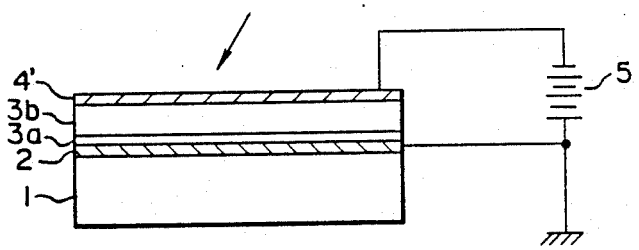
Figure 3:
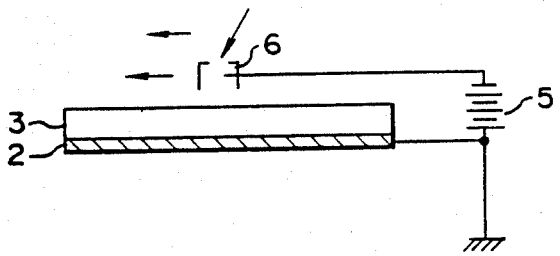

The method of the present invention is effected by using the photosensitive materials as illustrated in FIGS. 1 to 3.

In FIG. 1, 1 indicates a transparent substrate, 2 indicating substantially transparent metallic conductive layer; 3 indicating photoconductive layer (hereinafter referred to as "photosensitive layer"); 4 indicating a metal plate; and 5 indicating a power source.

The substrate generally has a thickness of 50–100 μm, and the electroconductive metal layer generally has a thickness of 100–500 Å.

As can be seen from the figure, an optical image is irradiated from the backside of the substrate 1 while applying voltage in such a manner as to make the electroconductive layer 2 positive and the photosensitive layer 3 negative. A cathode is a metal plate 4 closely adhered to the surface of the photosensitive layer 3. On the optical information-irradiated surface of the photosensitive layer 3, electron, positive hole pair occurs, and the positive hole moves toward the cathode 4. In this situation, as an electric field is given not by electrostatic charge but by an electric power source, the photosensitive layer and the electric power source form a closed loop on the light-irradiated part, thus stationary electric current flowing. At this time, the metal of the electroconductive layer as an anode is subjected to anodic oxidation depending on its properties. The metal oxide thus formed is generally transparent to visible light, and therefore an image corresponding to the optical pattern irradiated on the electroconductive layer is recorded. When the light transmits the electroconductive layer, "positive-positive" recording is effected. On the other hand, when using the mirror reflection action of the electroconductive layer, "positive-negative" recording is effected.

FIG. 2 shows an example of exposing from the surface of a photosensitive layer (so called "front exposure"), wherein 4' indicates a substantially transparent electrode applied on a photosensitive layer surface by vapor-depositing, sputtering or other techniques, **3-*b* indicating a charge transfer layer, 3-*a* indicating a charge generating layer, 2 indicating an electroconductive metal layer, and 1** indicating a substrate. The charge generating layer generally has a thickness of 0.1 μm–1 μm, and the charge transfer layer generally has a thickness of 5 μm–30 μm.

The principle of the image forming process is the same as mentioned above. In this case, the photosensitive layer is almost perfectly adhered to the cathode, and accordingly the image formed has no defect. Some of organic pigments used as a charge generating layer notably lose color in accordance with the anodic oxidization of metal, and therefore the image thus formed has a very high contrast. This type of photosensitive layer comprising a charge generating layer and a charge transfer layer can also be applied to the system of exposing from the substrate side.

FIG. 3 shows an example where exposure is effected by discharge current from a corona electrification apparatus 6. In order to simplify, a photoconductive layer and an electroconductive metal layer only are illustrated. With regard to the direction of exposure and the structure of the photosensitive layer, any type of the above mentioned can be employed. However, as indicated by the arrow, it is necessary that the electrification apparatus makes a relative motion along with the surface of the photosensitive layer, thus the exposed part moving on the surface of the photosensitive layer.

Applied voltage and light amount required vary depending on the material used, but the voltage is generally in the order of $10^2$ (V), the light amount being generally in the order of $10^2$ ($\mu W/cm^2$).

Examples of pigments used as a charge generating material in the charge generating layer in accordance with the present invention include well known materials as listed below:

(a) Disazo pigment having the general formula,

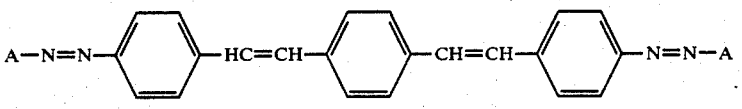

wherein A represents

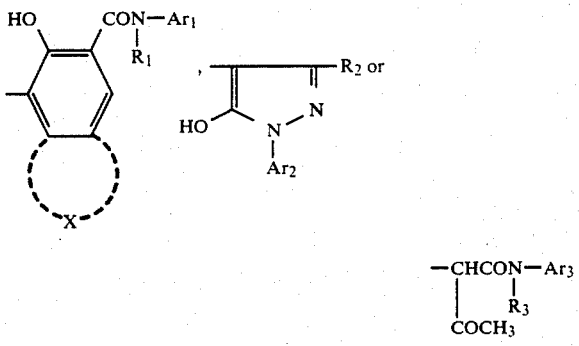

(wherein X represents at least one of benzene ring or its substituted material, naphthalene ring or its substituted material, indole ring or its substituted material, carbazole ring or its substituted material and benzofuran ring or its substituted material; $Ar_1$ representing at least one of benzene ring or its substituted material, naphthalene ring or its substituted material, carbazole ring or its substituted material and dibenzofuran ring or its substituted material; $Ar_2$ and $Ar_3$ respectively representing at least one of benzene ring or its substituted material and naphthalene ring or its substituted material; $R_1$ and $R_3$ respectively representing at least one of hydrogen, lower alkyl group and phenyl group or its substituted material; and $R_2$ representing at least one of lower alkyl group, and carboxyl group or its substituted material) (see Japanese Patent Laid Open No. 53-133445 of the present assignee);

(b) Disazo pigment having the general formula,

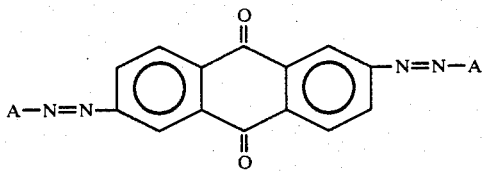

wherein A is the same as defined in the above general formula of disazo compound (a) (see Japanese Patent Laid Open No. 57-202545 of the present assignee);

(c) Disazo pigment having the general formula,

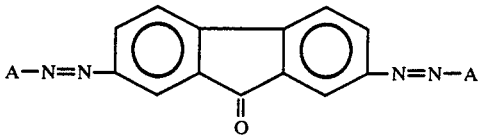

wherein A is the same as defined in the above general formula of disazo compound (a) (see Japanese Patent Laid Open No. 54-22834 of the present assignee);

(d) Disazo pigment having the general formula,

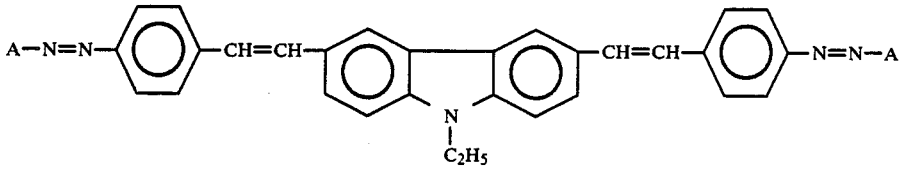

wherein A is the same as defined in the above general formula of disazo compound (a) (see Japanese Patent Laid Open No. 54-14967 of the present assignee);

(e) Azo pigment having the general formula,

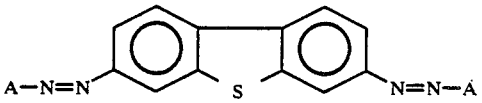

wherein A is the same as defined in the above general formula of disazo compound (a) (see Japanese Patent Laid Open No. 54-21728);

(f) Azo pigment having the general formula,

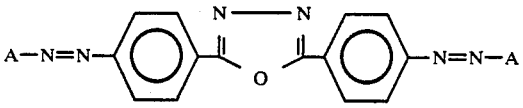

wherein A is the same as defined in the above general formula of disazo compound (a) (see Japanese Patent Laid Open No. 54-12742);

(g) Azo pigment having the general formula,

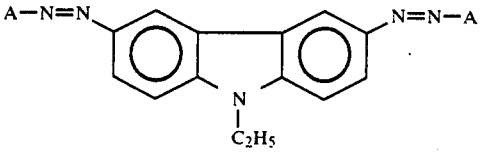

wherein A is the same as defined in the above general formula of disazo compound (a) (see Japanese Patent Laid Open No. 53-95033);

(h) Azo pigment having the general formula,

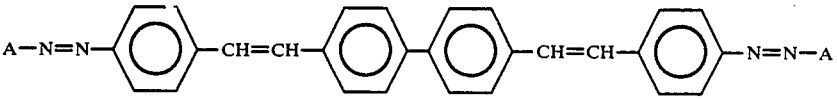

wherein A is the same as defined in the above general formula of disazo compound (a) (see Japanese Patent Laid Open No. 54-17733);

(i) Trisazo pigment having the general formula,

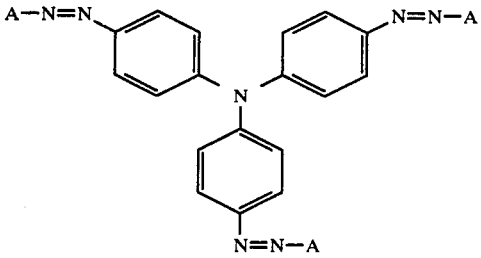

wherein A is the same as defined in the above general formula of disazo compound (a) (see Japanese Patent Laid Open No. 53-132347); and the like.

Examples of charge transfer materials used in the charge transfer layer in accordance with the present invention include, in addition to the materials used in the following Examples, as follows:

(a) 3,6-bis (dibenzyl amino) carbazole derivatives having the general formula,

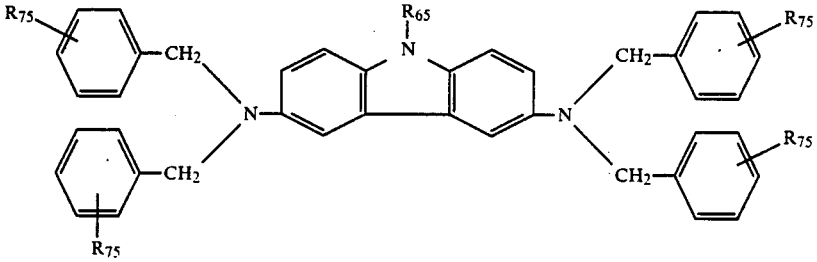

wherein $R_{65}$ represents an alkyl group of $C_1$–$C_3$, benzyl group or chlorine- or bromine-substituted benzyl group, and $R_{75}$ represents methyl group, chlorine, bromine, iodine or hydrogen (see Japanese Patent Laid Open No. 54-59142 of the present assignee);

(b) Compound having the general formula,

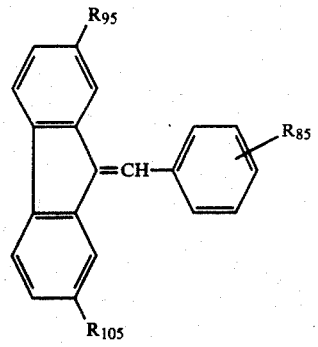

wherein $R_{85}$ represents hydrogen, alkyl group, nitro group, dialkylamino group, alkoxy group, nitrile group or carboxylic acid ester group, and $R_{95}$ and $R_{105}$ represent hydrogen, halogen atom, nitro group or dialkylamino group (see Japanese Patent Laid Open No. 54-110837 of the present assignee);

(c)

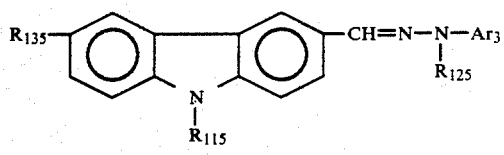

(wherein $R_{115}$ represents a substituted or non-substituted alkyl group such as methyl, ethyl, 2-hydroxyethyl, 2-chloroethyl and benzyl or a substituted or non-substituted phenyl group; $R_{125}$ represents methyl, ethyl, benzyl or substituted or non-substiteted phenyl group; and $R_{135}$ represents hydrogen, chlorine, bromine, alkyl having 1 to 4 carbon atoms, alkoxy having 1 to 4 carbon atoms, dialkylamino or nitro, and $Ar_3$ represents substiteted or non-substituted phenyl or naphthyl group.

(d)

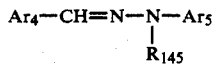

(wherein $Ar_4$ represents naphthalene ring, anthracene ring, styryl and their substituents or pyridine ring, furan ring, or thiophene ring; and $R_{145}$ represents substituted or non-substituted alkyl or substituted or non-substituted phenyl group, and $Ar_5$ represents substituted or non-substituted phenyl or naphthyl group.)

(e)

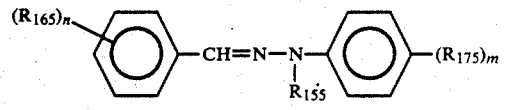

(wherein $R_{155}$ represents a substituted or non-substituted alkyl, substituted or non-substituted phenyl or naphthyl; $R_{165}$ and $R_{175}$ represent hydrogen, alkyl having 1 to 3 carbon atoms, alkoxy having 1 to 3 carbon atoms, dialkylamino, diaralkylamino or diarylamino; m and n represnt an integer of 1 to 4; when n is 2 or more, $R_{165}$ and $R_{175}$ may be the same or different.)

(f)

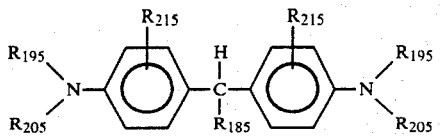

(wherein $R_{185}$ represents an alkyl group having 1 to 11 carbon atoms, substituted or non-substituted phenyl or heterocyclic group; $R_{195}$ and $R_{205}$ respectively may be the same or different and represent hydrogen, alkyl having 1 to 4 carbon atoms, hydroxyalkyl, chloroalkyl, substituted or non-substituted aralkyl or aryl group; $R_{195}$ and $R_{205}$ may be bonded with each other to form a heterocyclic ring containing nitrogen; $R_{215}$ may be the same or different and represents hydrogen, alkyl or alkoxy having 1 to 4 carbon atoms, or halogen.)

(g)

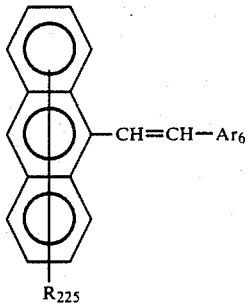

(wherein $R_{225}$ represents hydrogen or a halogen atom; and $Ar_6$ represents a substituted or non-substituted phenyl, naphthyl, anthryl or carbazolyl group.)

(h)

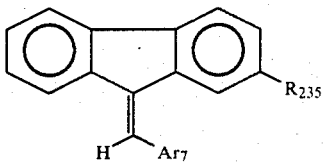

(wherein $R_{235}$ represents hydrogen, halogen, cyano, alkoxy having 1 to 4 carbon atoms or alkyl having 1 to 4 carbon atoms; $Ar_7$ represents

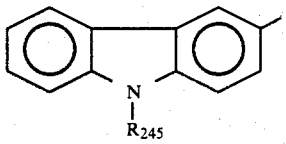

or

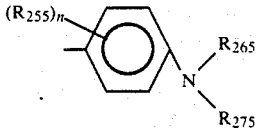

wherein $R_{245}$ represents substituted or non-substituted alkyl or substituted or non-substituted phenyl, $R_{255}$ represents hydrogen, halogen, alkyl having 1 to 4 carbon atoms, alkoxy having 1 to 4 carbon atoms or dialkyl amino, n is an integer of 1 or 2; when n is 2, $R_{255}$ may be the same or different; $R_{265}$ *an* $R_{275}$ represent hydrogen, substituted or non-substituted alkyl having 1 to 4 carbon atoms, substituted or non-substituted benzyl group, or substituted or non-substituted phenyl group.)

(i)

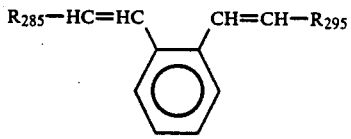

(wherein $R_{285}$ and $R_{295}$ represents carbazolyl, pyridyl, thienyl, indolyl, furyl, or substituted or non-substituted phenyl, styryl, naphthyl or anthryl group; these substituents are elected from the group of substituted or non-substituted dialkylamino, substituted or non-substituted diaryl amino, alkyl, alkoxy, carboxyl or its ester, halogen atom, cyano, amino, nitro and acetyl amino groups.)

(j)

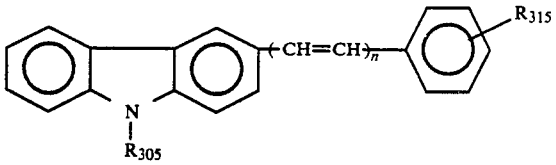

(wherein $R_{305}$ represents a substituted or non-substituted alkyl or substituted or non-substituted phenyl group; $R_{315}$ represents hydrogen, lower alkyl, lower alkoxy, halogen, nitro, amino, or dialkyl amino group substituted with lower alkyl, or substituted or non-substituted diaryl amino group; and n is an integer of 1 or 2.)

(k)

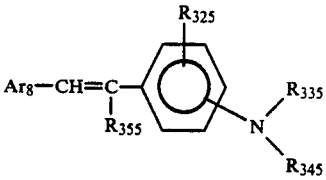

(wherein $R_{325}$ represents hydrogen, alkyl, alkoxy or halogen; $R_{335}$ and $R_{345}$ represent substituted or non-substituted alkyl, or substituted or non-substituted aryl group; $R_{335}$ and $R_{345}$ may be the same or different $R_{355}$ represents hydrogen or substituted or non-substituted phenyl; and $Ar_8$ represents a substituted or non-substituted aryl group.)

(l)

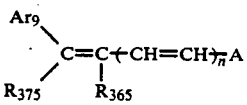

(wherein n is an integer of 0 or 1; $R_{365}$ represents hydrogen, substituted or non-substituted alkyl or substituted or non-substituted phenyl; $Ar_9$ represents a substituted or non-substituted aryl group; $R_{375}$ represents a substituted or non-substituted alkyl or substituted or non-substituted aryl group; A represents

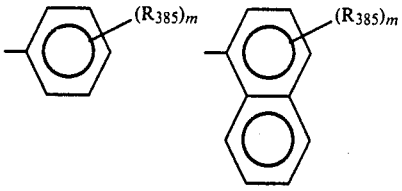

9-anthryl, or substituted or non-substituted carbazolyl group, wherein $R_{385}$ represents hydrogen, alkyl, alkoxy, halogen or

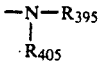

(wherein $R_{395}$ and $R_{405}$ represent substituted or non-substituted alkyl, substituted or non-substituted aryl group, and $R_{395}$ and $R_{405}$ may be the same or different and may form a ring); and m is an integer of 0, 1, 2 or 3, when m is 2 or more, $R_{385}$ may be the same or different.)

(m)

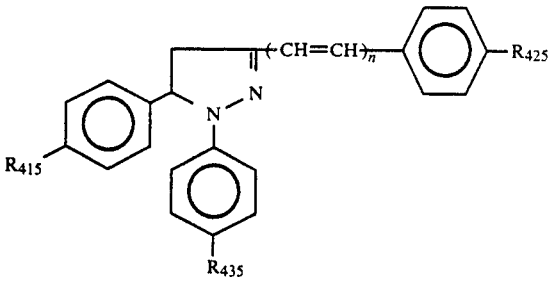

(wherein $R_{415}$ $R_{425}$ and $R_{435}$ are hydrogen, lower alkyl, lower alkoxy, dialkylamino, or halogen; and n is 0 or 1.)

(n)

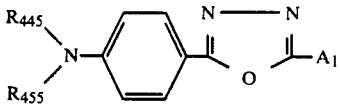

wherein $R_{445}$ and $R_{455}$ represent a substituted or non-substituted alkyl, or substituted or non-substituted aryl group; and $A_1$ represents a substituted amino group or substituted or non-substituted aryl or allyl group.

(o)

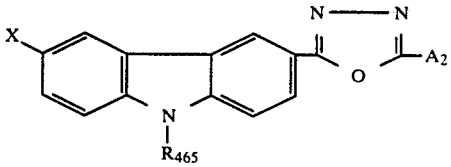

wherein X represents hydrogen, or halogen atom; $R_{465}$ represents a substituted or non-substituted alkyl or substituted or non-substituted aryl group; and $A_2$ represents a substituted amino, or substituted or non-substituted aryl or allyl group. (see Japanese Patent Laid Open No. 52-139065 of the present assignee); and the like.

Examples of the compounds expressed by the general formula (c) include: 9-ethylcarbazole-3-aldehyde-1-methyl-1-phenylhydrazone, 9-ethylcarbazole-3-aldehyde-1-benzyl-1-phenylhydrazone, 9-ethycarbazole-3-aldehyde 1, 1-diphenylhydrazone, and the like.

Examples of the compounds expressed by the general formula (d) include: 4-diethylaminostyrene-$\beta$-aldehyde-1-methyl-1-phenylhydrazone, 4-methoxynaphthalene-1-aldehyde-1-benzyl-1-phenylhydrazone, and the like.

Examples of the compounds expressed by the general formula (e) include: 4-methoxybenzaldehyde-1methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-benzyl-1-(4-methoxy)phenylhydrazone, 4-diphenylaminobenzaldehyde-1-benzyl-1-phenylhydrazone, 4-dibenzylaminobenzaldehyde-1,1-dephenylhydrazone and the like.

Examples of the compounds expressed by the general formula (f) include: 1,1-bis(4-dibenzyl-aminophenyl)-propane, tris (4-diethylaminophenyl)methane, 1,1-bis (4-dibenzylaminophenyl)propane, 2,2'-dimethyl-4,4'-bis (diethylamino)-triphenyl-methane and the like.

Examples of the compounds expressed by the general formula (g) include: 9-(4-diethyl-aminostyryl)anthracene, 9-bromo-10 (4-diethyl-aminostyryl)anthracene, and the like.

Examples of the compounds espressed by the general formula (h) include: 9-(4-dimethyl-aminobenzylidene)-fluorene, 3-(9-fluorenylidene)-9-ethylcarbazole, and the like.

Examples of the compounds expressed by the general formula (i) include: 1,2-bis(4-diethyl-aminostyryl)benzene, 1,2-bis(2,4-dimethoxystyryl)benzene and the like.

Examples of the compounds expressed by the general formula (j) include: 3-styryl-9-ethylcarbazole, 3-(4-methoxystyryl)-9-ethylcarbazole, and the like.

Examples of the compounds expressd by the general formula (k) include: 4-diphenylaminostilbene, 4-dibenzylaminostilbene, 4-ditolylaminostilbene, 1-(4-diphenylaminostyryl)naphthalene, 1-(4-diethyl-aminostyryl) napthylene, and the like.

Examples of the compounds expressed by the general formula (1) include: 4'-diphenylamino-alpha-phenylstilbene, 4-methylphenylamino-alpha-phenylstilbene, and the like.

Examples of the compounds expressed by the general formula (m) include: 1-phenyl-3-(4-diethylaminostyryl)-5-(4-diethylaminophenyl)-pyrazoline, 1-phenyl-3-(4-dimethylaminostyryl)5-(4-dimethylaminophenyl)-pyrazoline, and the like.

Other examples of the compounds expressed by the general formulas (m) and (o) include: oxadiazole compounds such as 2,5-bis(4-diethylaminophenyl)-1,3,4-oxadiazole, 2,5-bis(4-(4-diethylaminostyryl)phenyl)-1,3,4-oxadiazole 2-(9-ethylcarbazolyl-3)-5-(4-diethylaminophenyl)-1, 3,4-oxadiazole, and the like. Examples of other positive hole transfer materials include low molecular compounds such as 2-vinyl-4-(2-chlorophenyl)-5-(4-diethylaminophenyl)oxazole, 2-(4-diethylaminophenyl)-4-phenyloxazole, triphenyl amine, tri-p-tollyl amine, 4,4-dimethoxy triphenyl amine, N,N'-bis (3-methyl phenyl)-N,N'-diphenyl benzidine, 1,1-bis(4-di-p-tollyl aminophenyl)cyclohexane, N, N, N',N'-tetra(p-tollyl)benzidine and the like; and high molecular compounds such as poly-N-vinyl carbazole, halogenated poly-N-vinyl carbazole, polyvinyl pyrene, polyvinyl anthracene, pyrene formaldehyde resin, ethylcarbazole formaldehyde resin, and the like.

Examples of electron trasfer material include: chloroanil, bromoanil, tetracyanoethylene, tetracyanoquinonedimethane, 2,4,7-trinitro-9-fluorenone, 2,4,5,7-tetranitro-9-fluorenone, 2,4,5,7-tetranitro-xanthone, 2,4,8-trinitro-thioxanthone, 2,6,8trinitro-4H-indeno(1,2-b)-thiopene-4-on, 1,3,7-trinitrodibenzothiophene-5,5-dioxide, and the like.

These charge transfer materials are used alone or in the form of a mixture of two or more.

The present invention is further illustrated by the following Examples, but is not limited thereto.

EXAMPLE 1

Al was vapor-deposited on a polyester film substrate having a thickness of 75 um in such a manner as to make an average visible light transmissivity of the Al-deposited film 20%. A charge generating layer comprising a dispersion of disazo pigment of the following formula (I) in butyral resin (weight ratio of pigment/resin=2.5/1) was then blade-coated on the Al-deposited film in such a manner as to make a thickness 0.3 $\mu$m.

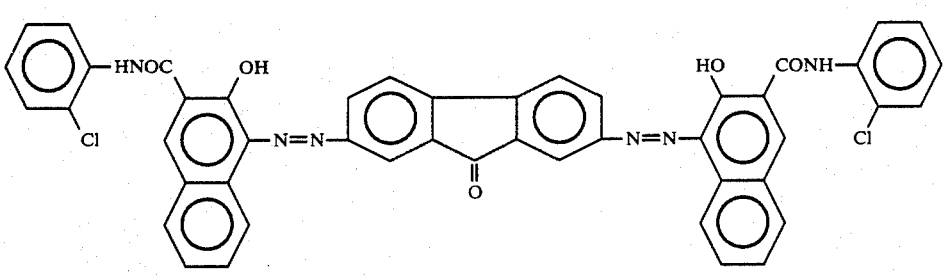

(I)

A charge transfer layer comprising styryl compound of the following formula (II) dissolved in polycarbonate resin (weight ratio of styryl compound/resin=9/10) was then blade-coated on the resultant layer in such a manner as to make a thickness of 20 $\mu$m.

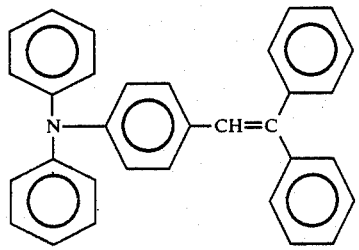

(II)

A brass plate having a polished surface like a mirror was placed on the above coated charge transfer layer. Thereafter, a voltage of 500 V was applied on the above prepared device by making the Al coating positive and the brass plate negative. At the same time, tungsten white light of about 100 $\mu W/cm^2$ was irradiated for about one minute through an optical wedge (having gradation from an optical density of 0.0 to 2.0) closely adhered to the polyester film substrate.

As this test result, it was recognized that, at the part corresponding to the part of an optical wedge having an optical density of 0.0, both the electroconductive layer (Al layer) and the charge generating layer (pigment layer) became substantially transparent, and that, at the part corresponding to the part of optical wedge having an optical density of 2.0, they showed substantially no change. In the half tone, the Al electroconductive layer and the pigment layer made gradation in proportion to each step of the optical wedge. A particle size of the pigment particles used was in the order of submicron. Therefore, pigment particles were sufficiently fine and the granularity was satisfactory as compared with silver salt film of low sensitivity.

EXAMPLE 2

The same procedure as in Example 1 was repeated, except that Ta was used in place of Al. The results were substantially the same as those of Example 1.

EXAMPLE 3

The same procedure as in Example 1 was repeated, except that Ti was used in place of Al. The results were substantially the same as those of Example 1, except that the contrast was a little low.

EXAMPLE 4

The same procedure as in Example 1 was repeated, except that Ti was vapor-deposited in a thickness of 200 Å on the charge transfer layer. The vapor-deposited Al layer is substantially transparent and is used as a cathode.

The photosensitive material thus prepared was subjected to front exposure under the same conditions as in Example 1. The image thus formed had substantially no defects.

EXAMPLE 5 TO 31

27 types of photosensitive materials were prepared in the same manner as in Example 1 by respectively combining four kinds of the following charge generating materials G-1 to G-4 with 7 kinds of the following charge transfer material T-1 to T-7. The respective combinations are shown in the following Table 1.

TABLE 1

| | Relation between Example Nos. and the Respective Combination | | | |
|---|---|---|---|---|
| | G-1 | G-2 | G-3 | G-4 |
| T-1 | Ex. 5 | Ex. 12 | Ex. 18 | Ex. 25 |
| T-2 | Ex. 6 | Ex. 13 | Ex. 19 | Ex. 26 |
| T-3 | Ex. 7 | Ex. 14 | Ex. 20 | Ex. 27 |
| T-4 | Ex. 8 | Ex. 15 | Ex. 21 | Ex. 28 |
| T-5 | Ex. 9 | Ex. 1 | Ex. 22 | Ex. 29 |
| T-6 | Ex. 10 | Ex. 16 | Ex. 23 | Ex. 30 |
| T-7 | Ex. 11 | Ex. 17 | Ex. 24 | Ex. 31 |

The four kinds of charge generating materials G-1 to G-4 are listed below.

G-1

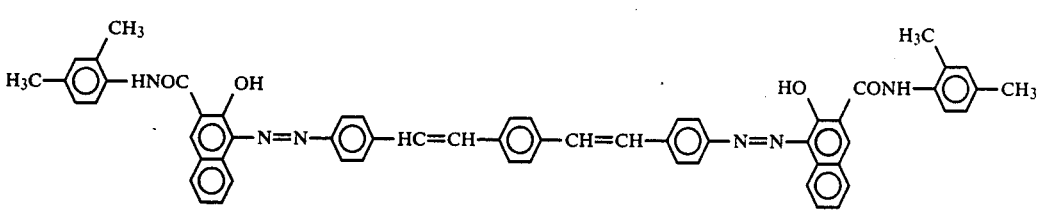

G-2

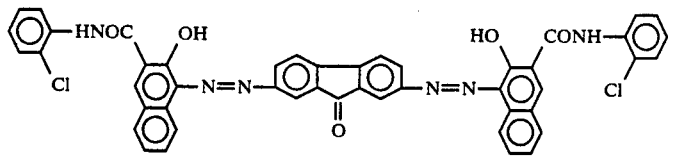

G-3

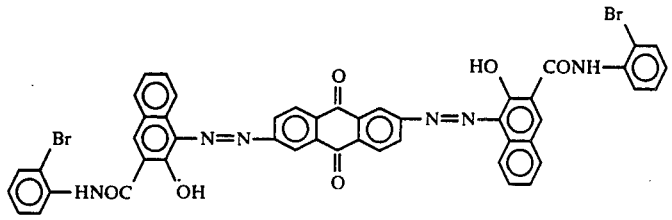

-continued

G-4

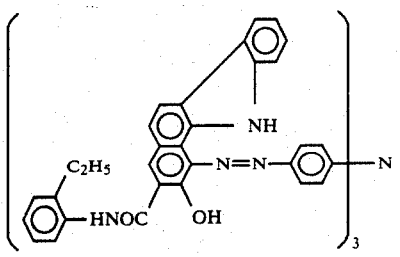

The seven kinds of charge transfer materials T-1 to T-7 are listed below.

-continued (T-1)

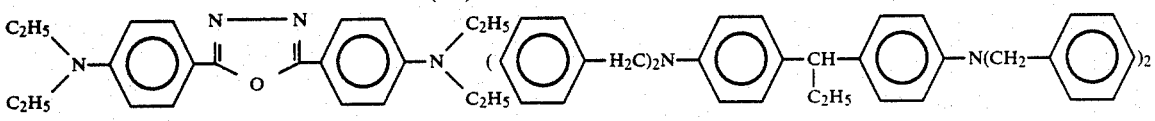

(T-2)

(T-3)

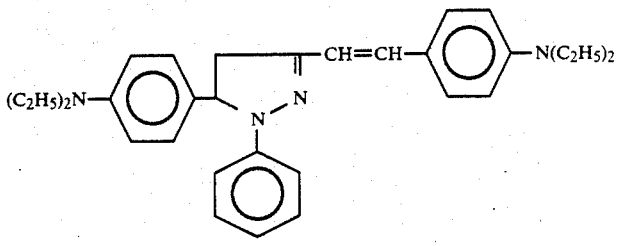

(T-4)

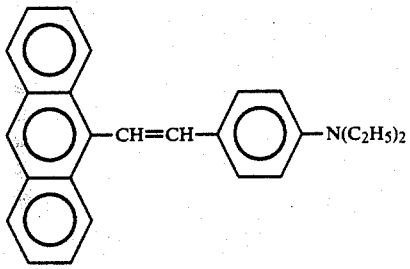

(T-5)

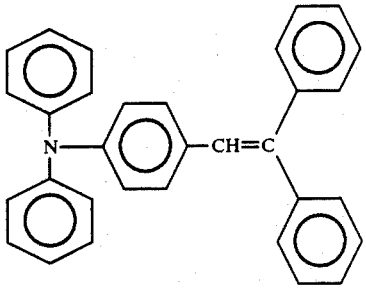

(T-6)

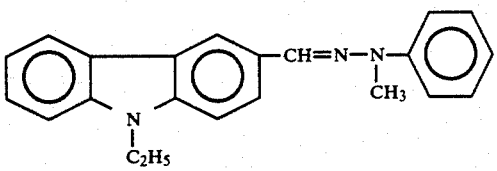

(T-7)

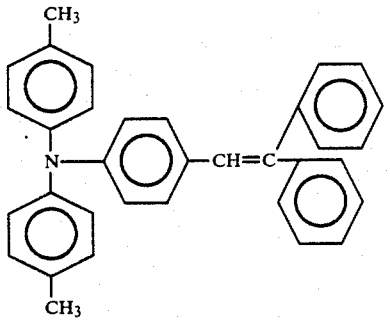

The test results are shown in the following Table 2.

| | G-1 | G-2 | G-3 | G-4 |
|---|---|---|---|---|
| T-1 | + | + | + | + |
| T-2 | + | + | + | + |
| T-3 | + | + | + | + |
| T-4 | + | + | + | + |
| T-5 | Δ | ○ | Δ | Δ |
| T-6 | ○ | ○ | ○ | ○ |
| T-7 | ◎ | ◎ | ◎ | ◎ |

In the above Table 2, the mark "+" represents the result that an image was formed by the irradiation with tungsten white light at 500 V for more than 15 minutes.

The mark "Δ" represents the result that an image was formed by irradiation at the same condition as above but for not more than 15 minutes.

The mark "○" represents the results that an image was formed by the irradiation at the same condition as above but for not more than 5 minutes.

The mark "⊙" represents the results that an image was formed by the irradiation at the same condition as above but for not more than 1 minute.

COMPARATIVE EXAMPLE 1

The same procedure as in Example 1 was repeated, except that Cr was used in place of Al, but an image contrast was very poor. Thus, metals such as Cr, which are hardly subjected to anodic oxidation, are not adequate in the present invention.

As mentioned above, a method for forming an image is effected by changing the spectrum absorption properties of at least one of a metal anode and a charge generating material in accordance with ionic reaction caused by constantly flowing photo-current for a predetermined time. Thus, metals used as an anode must be easily anodically oxidized, examples of which include Al, Ta, V, Nb, Zr, Ti, Si, Pb, W, Mg, Zn, Cd, Ni, Co, Fe and the like. Among them, Al is the best in view of cost, easy vapor-deposition, non-toxicity, accurate reaction properties and the like.

A weight ratio of a charge generating material or charge transfer material to a binder resin is generally about 0.2–1.8 to 1. Examples of a binder resin include polyamide, cellulose type resin, vinyl chloride, nitrile rubber, polyurethane, acrylonitrile, ABS, polyester, polycarbonate and the like.

The method of the present invention is based on discoloration by light absorption. Accordingly, it is to be noted that it is easily conceivable to those skilled in the art to achieve coloring effect by using a mixture of three types of cyan, magenta and yellow pigments. This kind of modification is within the scope of the present invention.

What we claim is:

1. A method of forming an image, which comprises applying voltage on a photosensitive material comprising an electroconductive cathode layer in contact with a photoconductive layer consisting essentially of a charge-generating organic pigment and a metallic electroconductive anode layer comprising at least one metal selected from the group consisting of Al, Ta, V, Nb, Zr, Ti, Si, Pb, W, Mg, Zn, Cd, Ni, Co and Fe, on a substrate in such a manner as to make said electroconductive anode layer positive and said photoconductive layer negative and simultaneously irradiating optical information on said positive electroconductive anode layer or said negative photoconductive layer, thereby causing an anodic ion reaction on the interface between said electroconductive anode layer and said photoconductive layer to selectively change the spectral absorption properties of at least one of said electroconductive anode layer and said photoconductive layer depending on the irradiated optical information; said photosensitive material comprising said metallic electroconductive anode layer applied on said substrate and said photoconductive layer overlaid on said electroconductive anode layer.

2. A method of forming an image, which comprises applying voltage on a photosensitive material comprising an electroconductive cathode layer in contact with a photoconductive layer, said photoconductive layer comprising a charge-generating layer and a charge-transfer layer laminated in that order on said electroconductive layer, said charge-generating layer consisting essentially of a charge-generating organic pigment, and a metallic electroconductive anode layer comprising at least one metal selected from the group consisting of Al, Ta, V, Nb, Zr, Ti, Si, Pb, W, Mg, Zn, Cd, Ni, Co and Fe, on a substrate in such a manner as to make said electroconductive anode layer positive and said photoconductive layer negative and simultaneously irradiating optical information on said positive electroconductive anode layer or said negative photoconductive layer, thereby causing an anodic ion reaction on the interface between said electroconductive anode layer and said photoconductive layer to selectively change the spectral absorption properties of at least one of said electroconductive anode layer and said photoconductive layer depending on the irradiated optical information; said photosensitive material comprising said metallic electroconductive anode layer applied on said substrate and said photoconductive layer overlaid on said electroconductive anode layer.

3. The method according to claim 2, wherein said charge generating layer comprises an azo pigment.

4. The method according to claim 3, wherein said azo pigment has the general formula,

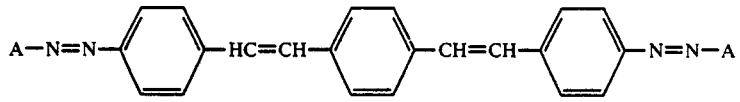

wherein A is

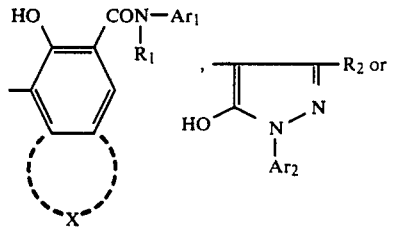

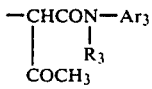

wherein X is benzene, substituted benzene, naphthalene, substituted naphthalene, indole, substituted indole, carbazole, substituted carbazole, benzofuran or substituted benzofuran; $Ar_1$ is benzene, substituted benzene, naphthalene, substituted naphthalene, carbazole, substituted carbazole, dibenzofuran or substituted dibenzofuran; $Ar_2$ and $Ar_3$ respectively are benzene, substituted benzene, naphthalene or substituted naphthalene; $R_1$ and $R_3$ respectively is hydrogen, lower alkyl, phenyl or substituted phenyl; and $R_2$ is lower alkyl, carboxyl or substituted carboxyl.

5. The method according to claim 3, wherein said azo pigment has the general formula,

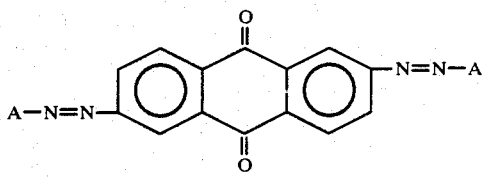

wherein A is

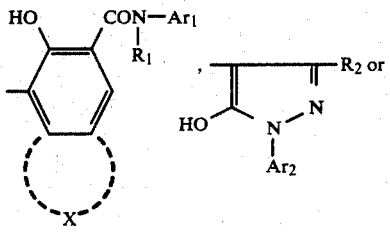

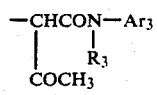

wherein X is benzene, substituted benzene, naphthalene, substituted naphthalene, indole, substituted indole, carbazole, substituted carbazole, benzofuran or substituted benzofuran; $Ar_1$ is benzene, substituted benzene, naphthalene substituted naphthalene, carbazole, substituted carbazole, dibenzofuran or substituted dibenzofuran; $Ar_2$ and $Ar_3$ respectively are benzene, substituted benzene, naphthalene or substituted naphthalene; $R_1$ and $R_3$ respectively are hydrogen, lower alkyl, phenyl or substituted phenyl; and $R_2$ is lower alkyl, carboxyl or substituted carboxyl.

6. The method according to claim 3, wherein said azo pigment has the general formula,

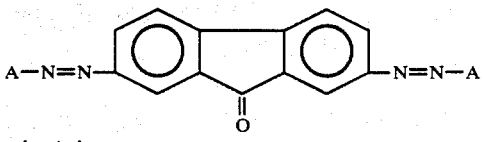

wherein A is

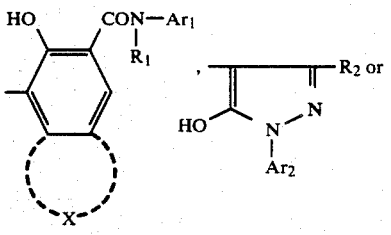

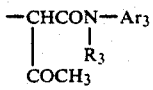

wherein X is benzene, substituted benzene, naphthalene, substituted naphthalene, indole, substituted indole, carbazole, substituted carbazole, benzofuran or substituted benzofuran; $Ar_1$ is benzene, substituted benzene, naphthalene, substituted naphthalene, carbazole, substituted carbazole, dibenzofuran or substituted dibenzofuran; $Ar_2$ and $Ar_3$ respectively are benzene, substituted benzene, naphthalene or substituted naphthalene; $R_1$ and $R_2$ respectively are hydrogen, lower alkyl, phenyl or substituted phenyl; and $R_2$ is lower alkyl, carboxyl or substituted carboxyl.

7. The method according to claim 3, wherein said azo pigment has the general formula,

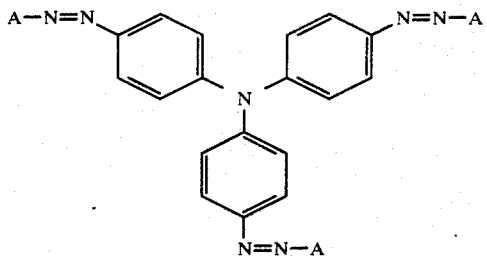

wherein A is

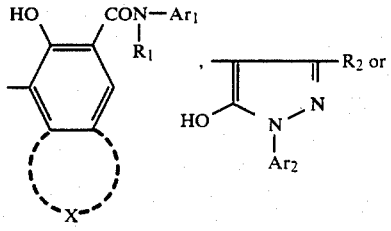

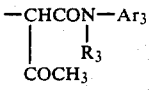

wherein X is benzene, substituted benzene, naphthalene, substituted naphthalene, indole, substituted indole, carbazole, substituted carbazole, benzofuran or substituted benzofuran; $Ar_1$ is benzene, substituted benzene, naphthalene substituted naphthalene, carbazole, substituted carbazole, dibenzofuran or substituted dibenzofuran; $Ar_2$ and $Ar_3$ respectively are benzene, substituted benzene, naphthalene or substituted naphthalene; $R_1$ and $R_3$ respectively are hydrogen, lower alkyl, phenyl or substituted phenyl; and $R_2$ is lower alkyl, carboxyl or substituted carboxyl.

8. The method according to claim 2, wherein said charge transfer layer comprises a styryl compound dissolved in resin.

9. The method according to claim 2, wherein said charge transfer layer comprises a hydrazone compound dissolved in resin.

10. The method according to claim 2, wherein said charge transfer layer comprises an oxadiazole compound dissolved in resin.

11. The method according to claim 2, wherein said charge transfer layer comprises a diphenyl methane compound dissolved in resin.

12. The method according to claim 2, wherein said charge transfer layer comprises a pyrazoline compound dissolved in resin.

13. A method of forming a visible image, consisting essentially of:

imagewise exposing to light a photosensitive material consisting essentially of the following layers in face-to-face contact with each other in the following order, a substrate layer, an electroconductive metal anode layer on said substrate layer, said electroconductive metal anode layer consisting essentially of at least one metal selected from the group consisting of Al, Ta, V, Nb, Zr, Ti, Si, Pb, W, Mg, Zn, Cd, Ni, Co and Fe, said metal undergoing anodic oxidation when subjected to a continuously flowing photocurrent, a photoconductive layer on said electroconductive metal anode layer, said photoconductive layer consisting essentially of a charge generating organic pigment, and an electroconduct cathode layer on said photoconductive layer;

simultaneously externally applying a voltage across said photosensitive material so that said electroconductive metal anode layer is an anode, said electroconductive cathode layer is a cathode, and said photoconductive layer is electrically negative relative to said electroconductive metal anode layer, said imagewise exposing step also generating photocurrents in the illuminated areas of said photoconductive layer and thereby causing an anodic oxidation reaction on the interface between said electroconductive metal anode layer and said photoconductive layer to selectively change the spectral absorption properties of at least one of said electroconductive metal anode layer and said photoconductive layer and thereby form said visible image.

14. A method as claimed in claim 1 in which the opposite faces of said photoconductive layer are in face-to-face contact with said metallic electroconductive anode layer and said electrocondutive cathode layer, and said voltage is applied across said metallic electroconductive layer, as an anode, and said electroconductive cathode layer as a cathode.

* * * * *

UNITED STATES PATENT AND TRADEMARK OFFICE

CERTIFICATE OF CORRECTION

PATENT NO. : 4 702 979

DATED : October 27, 1987

INVENTOR(S) : Satoshi OTOMURA et al

It is certified that error appears in the above-identified patent and that said Letters Patent is hereby corrected as shown below:

Column 20, line 1; change "$R_2$" to ---$R_3$---.

Signed and Sealed this

Twelfth Day of April, 1988

*Attest:*

*Attesting Officer*

DONALD J. QUIGG

*Commissioner of Patents and Trademarks*